US006019024A

United States Patent [19]

Robinson et al.

[11] Patent Number: 6,019,024

[45] Date of Patent: Feb. 1, 2000

[54] COMPACT OPERATING SYSTEM FOR AUTOMATIC RIFLES

[75] Inventors: Alexander J. Robinson, Salt Lake City; Darin G. Nebeker, Layton, both of Utah

[73] Assignee: ZDF Import Export, Inc., Salt Lake City, Utah

[21] Appl. No.: 09/013,101

[22] Filed: Jan. 26, 1998

[51] Int. Cl.[7] ..... F41A 3/20

[52] U.S. Cl. ..... 89/1.42; 89/191.01

[58] Field of Search ..... 89/1.42, 191.01, 89/191.02, 192, 193

[56] References Cited

U.S. PATENT DOCUMENTS

| | | | |
|---|---|---|---|
| 2,144,241 | 1/1939 | Eiane | 89/145 |
| 3,593,452 | 7/1971 | Pekarek | 42/16 |
| 3,675,534 | 7/1972 | Beretta | 89/185 |
| 3,688,640 | 9/1972 | Seecamp | 89/138 |
| 3,710,495 | 1/1973 | Ziegler et al. | 42/69.03 |
| 3,771,415 | 11/1973 | Into et al. | 89/16 |
| 3,776,095 | 12/1973 | Atchisson | 89/128 |
| 3,846,928 | 11/1974 | Ruger et al. | 42/16 |
| 3,847,054 | 11/1974 | Ruger et al. | 89/129.02 |
| 3,850,076 | 11/1974 | Atchisson | 89/196 |
| 3,857,323 | 12/1974 | Ruger et al. | 89/191.01 |
| 3,999,461 | 12/1976 | Johnson et al. | 89/191.01 |
| 4,023,465 | 5/1977 | Inskip | 89/131 |
| 4,028,993 | 6/1977 | Reynolds | 89/130 |
| 4,056,038 | 11/1977 | Rath | 89/128 |
| 4,057,003 | 11/1977 | Atchisson | 89/138 |
| 4,058,922 | 11/1977 | Elbe et al. | 42/16 |
| 4,066,000 | 1/1978 | Rostocil | 89/198 |
| 4,116,193 | 9/1978 | Chiba | 124/72 |
| 4,244,273 | 1/1981 | Langendorf, Jr. et al. | 89/193 |
| 4,358,986 | 11/1982 | Giorgio | 89/142 |
| 4,389,919 | 6/1983 | Kast et al. | 89/185 |
| 4,433,610 | 2/1984 | Tatro | 89/148 |
| 4,438,678 | 3/1984 | Ruger | 89/138 |
| 4,469,006 | 9/1984 | Teppa | 89/149 |
| 4,475,438 | 10/1984 | Sullivan | 89/191.01 |

(List continued on next page.)

FOREIGN PATENT DOCUMENTS

| | | | |
|---|---|---|---|
| 577419 | 5/1946 | United Kingdom | 89/191.01 |
| 2091391 | 7/1982 | United Kingdom | 89/191.01 |

*Primary Examiner*—Stephen M. Johnson
*Attorney, Agent, or Firm*—Lloyd W. Sadler

[57] ABSTRACT

An operating system for automatic rifles is described which permits a user to easily remove and replace the bolt and bolt carrier from the rifle, without requiring the user to employ special tools. This invention permits the user to reconfigure the rifle to fire a wide range of different calibers of cartridges, as well as to reconfigure the rifle to feed ammunition from either the top or the bottom of the firearm. This invention further improves the reliability and decreases the manufacturing cost of the operating system by reducing the number of required components. This invention also provides an ergonomic, left hand sided, non-reciprocating cocking handle. The cocking handle assembly is provided with a slot cover which keeps debris from entering the interior of the rifle.

4 Claims, 15 Drawing Sheets

U.S. PATENT DOCUMENTS

| | | | |
|---|---|---|---|
| 4,502,367 | 3/1985 | Sullivan | 89/181 |
| 4,523,509 | 6/1985 | Thevis et al. | 89/129.02 |
| 4,553,469 | 11/1985 | Atchisson | 89/191.02 |
| 4,562,659 | 1/1986 | Neta | 42/75.03 |
| 4,579,034 | 4/1986 | Holloway | 89/33.1 |
| 4,693,170 | 9/1987 | Atchisson | 89/149 |
| 4,756,228 | 7/1988 | Rath | 89/191.01 |
| 4,765,224 | 8/1988 | Morris | 89/191.01 |
| 4,791,851 | 12/1988 | Stoner | 89/156 |
| 4,867,040 | 9/1989 | Barrett | 89/172 |
| 4,872,391 | 10/1989 | Stoner | 89/155 |
| 4,893,547 | 1/1990 | Atchisson | 89/187.01 |
| 4,920,678 | 5/1990 | Brown | 42/25 |
| 4,920,855 | 5/1990 | Waters | 89/172 |
| 4,932,148 | 6/1990 | Barrett | 42/18 |
| 4,942,802 | 7/1990 | Stoner | 89/191.01 |
| 5,046,275 | 9/1991 | Brown | 42/25 |
| 5,103,714 | 4/1992 | LaFrance | 89/129.01 |
| 5,117,735 | 6/1992 | Flashkes | 89/191.01 |
| 5,123,329 | 6/1992 | Irwin | 89/161 |
| 5,551,179 | 9/1996 | Young | 42/16 |
| 5,581,926 | 12/1996 | Taalib-din et al. | 42/16 |
| 5,634,288 | 6/1997 | Martel | 42/71.01 |
| 5,663,522 | 9/1997 | Kuehl | 89/128 |
| 5,680,724 | 10/1997 | Peterken | 42/70.11 |

COMPACT OPERATING SYSTEM FOR AUTOMATIC RIFLES

I. BACKGROUND OF THE INVENTION

A. Field of the Invention

This invention relates to firearms and the operating systems for firing rifles. More specifically, this invention relates operating systems for rifles which are designed to accommodate the easy removal and replacement of the bolt and bolt carrier, thereby permitting the rifle to be reconfigured to fire different calibers of ammunition, and which are designed to permit the fire control system to be positioned on multiple sides of the receiver, thereby providing a operating system which can be configured by the user to receive ammunition from the top, bottom or either side of the firearm.

B. Description of Related Art

Operating systems for rifles are well known in the art. Certain well known rifles have provided for the removal and replaceability of certain components of the firearm's operating system. Often, such weapons require special tools for the disassembly and/or assembly of the rifle and are not well suited to reconfiguration in the field. A variety of operating systems for rifles have been disclosed. For general background material, the reader is directed to U.S. Pat. Nos. 3,593,452, 3,675,534, 3,688,640, 3,710,495, 3,771,415, 3,776,095, 3,846,928, 3,847,054, 3,850,076, 3,857,323, 3,999,461, 4,023,465, 4,028,993, 4,056,038, 4,057,003, 4,058,922, 4,066,000, 4,116,193, 4,128,042, 4,244,273, 4,358,986, 4,389,919, 4,433,610, 4,438,678, 4,469,006, 4,475,438, 4,502,367, 4,523,509, 4,562,659, 4,579,034, 4,693,170, 4,756,228, 4,765,224, 4,791,851, 4,867,040, 4,872,391, 4,893,547, 4,920,678, 4,920,855, 4,932,148, 4,942,802, 5,046,275, 5,103,714, 5,123,329, 5,551,179, 5,581,926, 5,634,288, 5,663,522, 5,680,724, each of which is hereby incorporated by reference in its entirety for the material disclosed therein.

II. SUMMARY OF THE INVENTION

This invention is a compact operating system for automatic rifles. For the purpose of this invention "automatic" is defined as including semi-automatic, select fire, or fully automatic; "cock" is defined as the step of rotating a firearm's hammer into firing position; "receiver" is defined as the component of the firearm comprising an upper receiver and a lower receiver; and "control components" is defined to include the trigger, disconnect, hammer and the safety/selector. The operating system of this invention includes new embodiments of well known rifle components, including: an operating rod, a recoil spring, a bolt carrier containing a bolt and which is designed to be quickly attached or detached from the operating rod. The bolt carrier, for example, is designed with a sloped edge to allow the bolt carrier to smoothly rotate the hammer into the cocked position, whether the lower receiver, containing the fire control components, is positioned on either side of the receiver.

It is desirable to provide an operating system for automatic rifles which provides a bolt and bolt carrier designed to be easily removable from the rifle. This is desirable because it is desirable to have a firearm which can be easily reconfigured, by the user in the field without the use of special purpose tools, to permit the firearm to fire more than one caliber of ammunition and to provide easier cleaning and disassembly of the firearm. Moreover, it is desirable to provide an operating system for automatic rifles which has few parts, thereby improving the weapon's reliability while reducing the cost of manufacture of the rifle. It is also desirable to provide an operating system which has a non-reciprocating cocking handle normally on the left side of the weapon to improve the ergonomics of the rifle. It is desirable to provide an operating system with a cocking handle slide which covers the cocking handle slot to keep debris out of the receiver. It is also desirable to provide an operating system which has a bolt carrier which can cock the hammer whether the lower receiver is attached to the top or the bottom of the upper receiver. Also, it is desirable to provide an operating system which provides an operating system with a hammer that can strike the firing pin from either top or the bottom of the firearm. Further, it is desirable to provide an operating system with a receiver that can be configured by the user to feed ammunition from either the top or the bottom of the firearm.

Accordingly, it is an object of this invention to provide a rifle operating system which has a bolt and bolt carrier which can be easily removed and replaced by the user without requiring the use of special tools.

It is a further object of this invention to provide a rifle operating system which permits the bolt carrier to be removed from the rifle without removing the cocking handle.

It is a still further object of this invention to provide a rifle operating system which makes use of a non-reciprocating cocking handle positioned on the left side of the rifle.

Another object of this invention is to provide a rifle operating system which provides a cocking handle slide to cover the cocking handle slot to keep debris from gaining access to the internal components of the operating system.

A further objective of this invention is to provide a rifle operating system which provides a forward assist mechanism attached to the cocking handle, and which when depressed, engages the rear side of the engagement surface of the operating rod.

It is a further object of this invention to provide a rifle operating system which has a hammer that is designed to permit it to be rotated into a firing position and to strike the firing pin from more than only one side of the rifle's receiver.

A still further object of this invention is to provide a rifle operating system which has fewer required parts.

Another object of this invention is to provide a rifle operating system which can be quickly and easily assembled, disassembled and reassembled by the user in the field without requiring special tools and which minimizes the risk of losing parts.

A further object of the invention is to provide a rifle operating system which provides a bolt carrier that can cock the hammer whether the lower receiver is attached to the top or the bottom of the firearm.

It is yet a further object of this invention to provide a rifle operating system which has a receiver that can be configured to receive ammunition from either the top or the bottom of the firearm.

These and other objects of this invention are intended to be covered by this disclosure and will be readily apparent to those of ordinary skill in the art upon consideration of the following detailed description, present preferred embodiment, claims and drawings of this disclosure.

III. BRIEF DESCRIPTION OF THE DRAWINGS

IV. DETAILED DESCRIPTION OF THE PREFERRED EMBODIMENT OF THE INVENTION

This invention is a compact operating system for automatic firearms, consisting of an operating rod; a recoil spring; a bolt carrier, containing the bolt, not shown in detail, and which is designed to be quickly attached to or detached from the operating rod using an innovative bolt carrier release mechanism. This invention also includes an improved receiver and cocking handle. In sum, this invention is a novel combination of rifle operating system components each having important improvements which cooperate to provide a rifle operating system which is easily reconfigurable, by the user in the field without requiring special purpose tools, to fire a wide variety of cartridges in a number of configurations.

Figure 1:
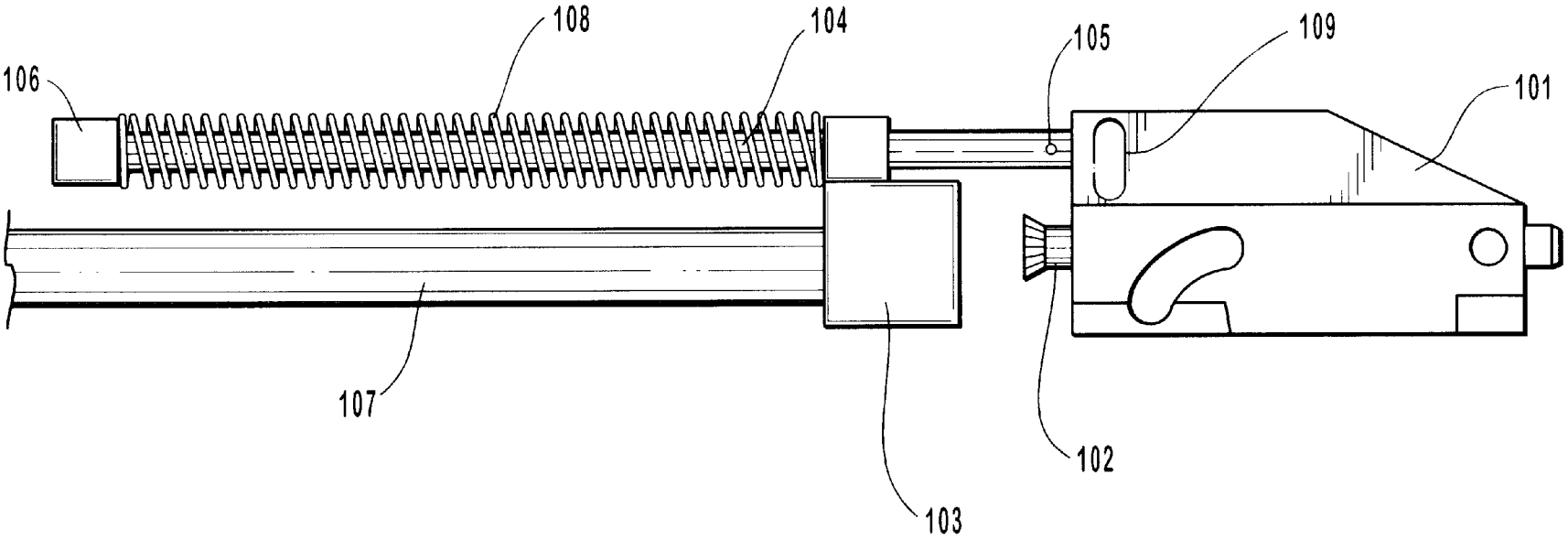
FIG. 1 depicts the preferred embodiment of the firearm operating system of this invention.

FIG. 1 shows a side view of the major components of the preferred embodiment of the firearm operating system of this invention. A bolt carrier 101 is provided which has openings (shown in FIG. 8 as 803, 802) to receive a bolt 102 and an operating rod 104. Prior to installation of the bolt carrier 101, the operating rod 104 is held in the upper receiver, using an operating rod protrusion or pin 105. The operating catch cavity 109 is shown on the upper left side of the bolt carrier 101. A trunion 103 is provided to give mechanical support to the operating rod 104 and the barrel 107. The operating rod 104 has a recoil spring 108 which in combination with the piston head 106 forces the operating rod 104 to cycle the action of the bolt carrier 101. The preferred bolt carrier 101 is made from machined or cast steel, adapted to accommodate the attachment of referenced components.

Figure 2:
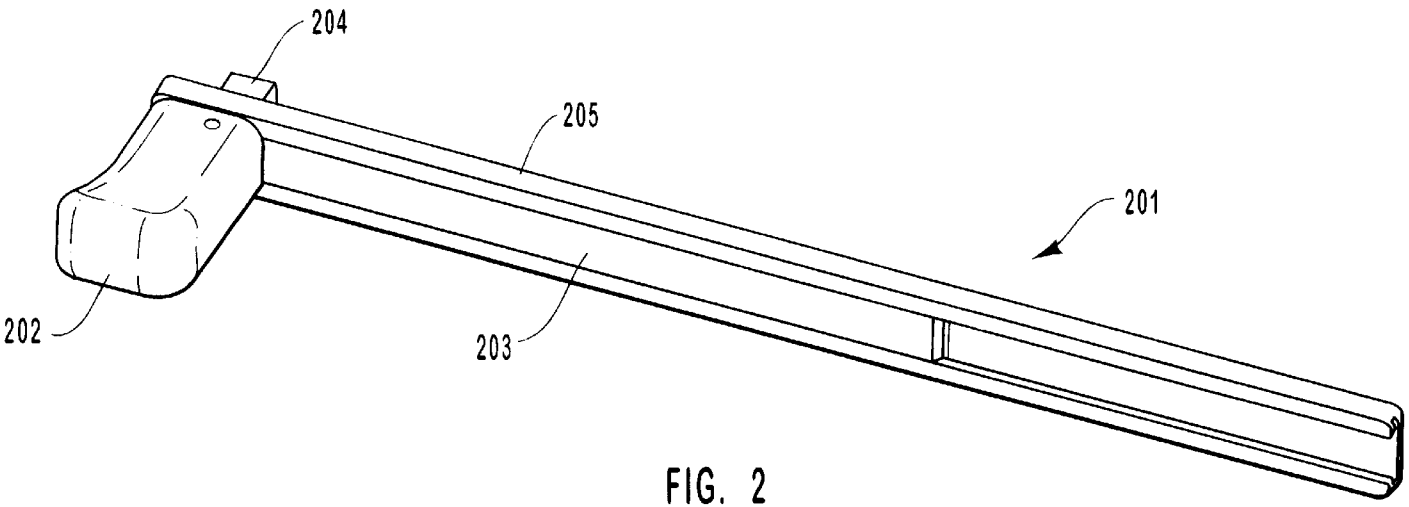
FIG. 2 depicts a detailed drawing of the preferred cocking handle assembly.

FIG. 2 shows a detailed drawing of the preferred cocking handle assembly. The cocking handle assembly 201 has a cocking handle 202 attached to the slide 203, which in turn is designed to slide along a slide channel 205. The cocking handle 202 and slide 203 are held in place in the slide channel 205 by a detent pin 601 and spring 602. Additional assembly detail of the cocking handle assembly 201 is provided in FIG. 6. The preferred material for the slide 203 and the slide channel 205 is sheet metal, while the cocking handle 202 is preferably made from metal, plastic or a composite material.

Figure 3:
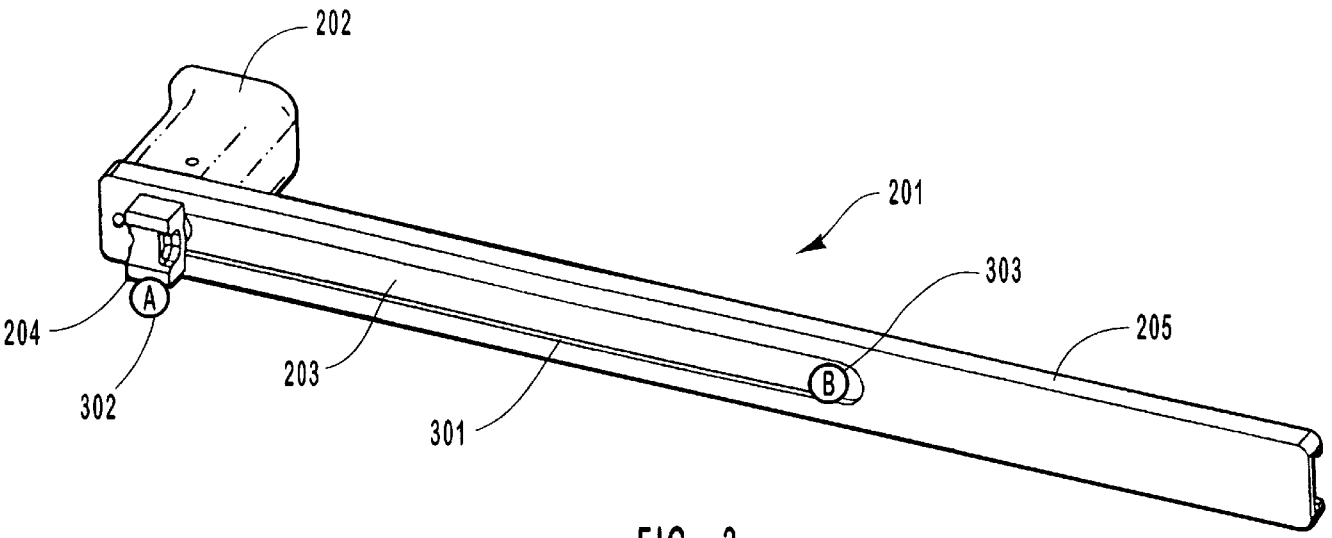
FIG. 3 depicts a reverse view of the preferred cocking handle assembly.

FIG. 3 provides a reverse view of the preferred cocking handle assembly 201 which shows the cocking handle slot 301, which is provided to permit the cocking handle 202 and the cocking piece 204 to move with little resistance from point A 302 to point B 303 and back to point A 302.

Figure 4:
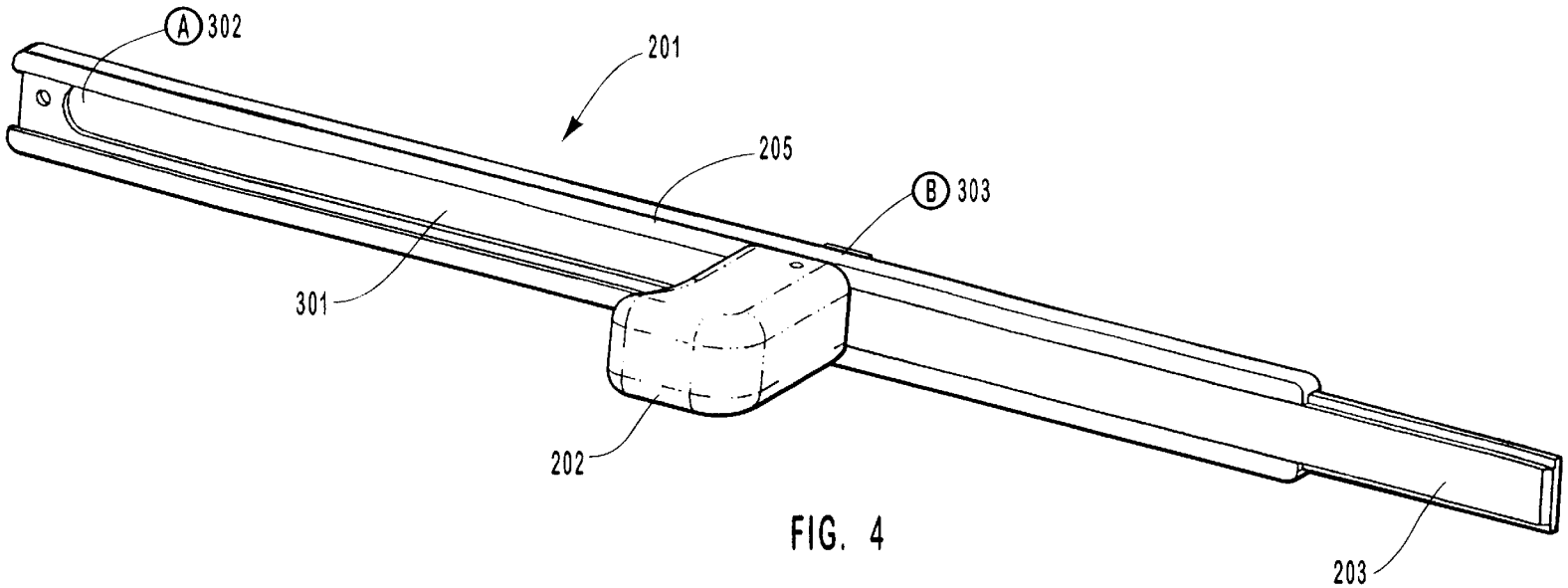
FIG. 4 depicts the preferred cocking handle assembly with the handle repositioned in the slide.

FIG. 4 provides an additional view of the preferred cocking handle assembly 201 with the cocking handle 202 at point B 303 in the slide channel 205. In this view the slide 203 is shown extending from the slide channel 205.

Figure 5:
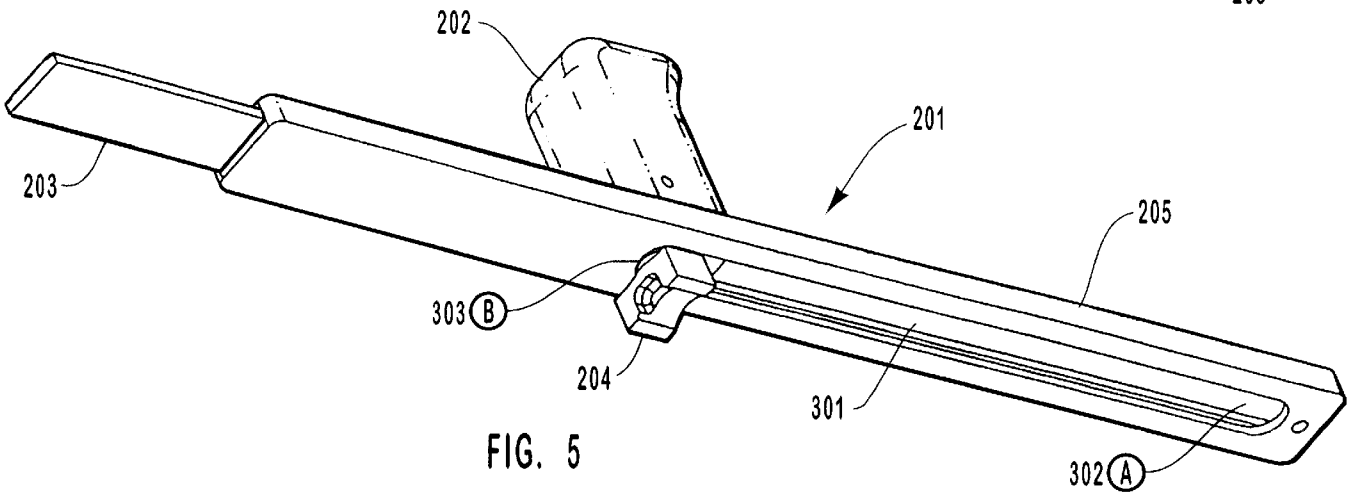
FIG. 5 depicts a reverse view of the preferred cocking handle assembly with the handle repositioned in the slide.

FIG. 5 provides the reverse view of the preferred cocking handle assembly 201, again with the cocking handle 202 at point B 303 in the slide channel 205.

Figure 6:
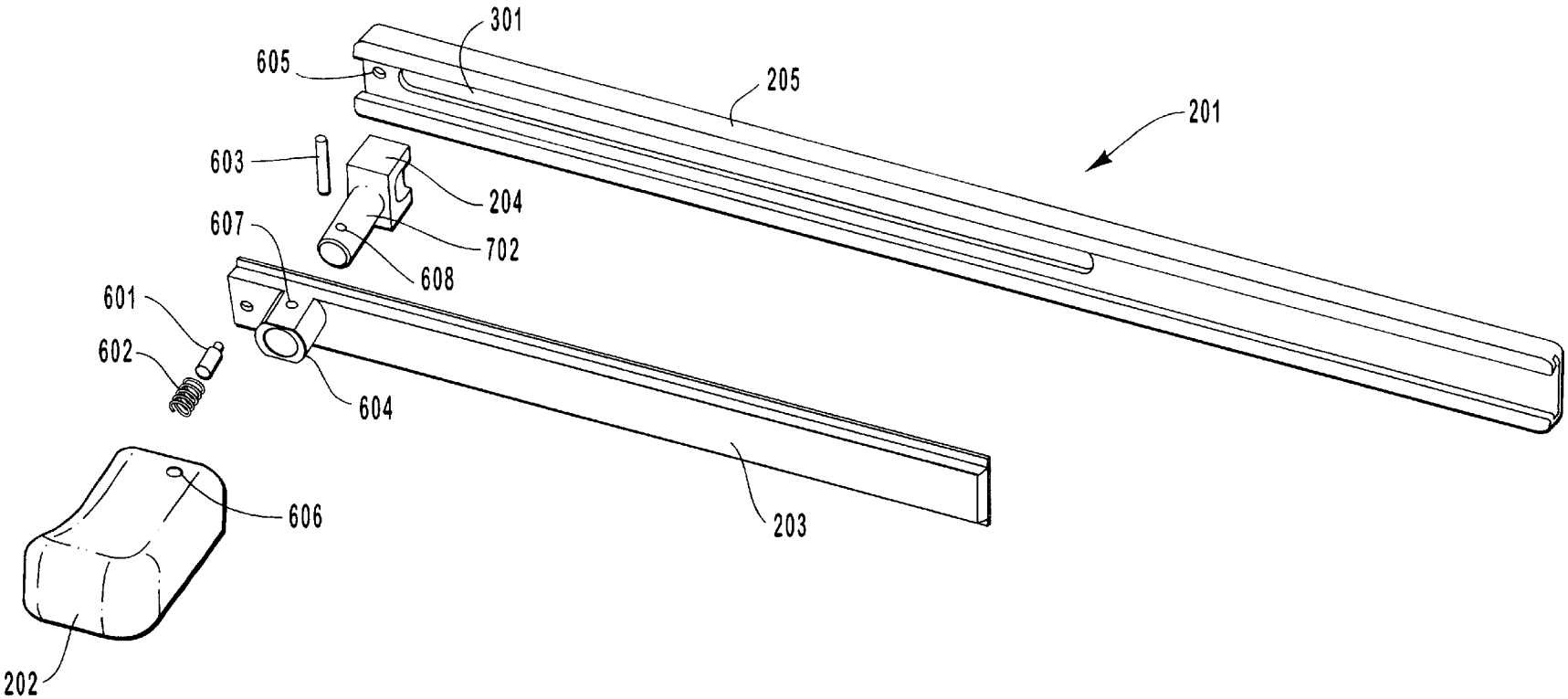
FIG. 6 depicts an exploded view of the cocking handle assembly.
Figure 7A:
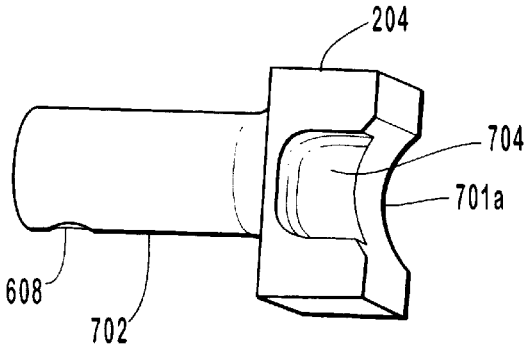
FIG. 7 depicts a variety of views of the preferred cocking handle piece.
Figure 7B:
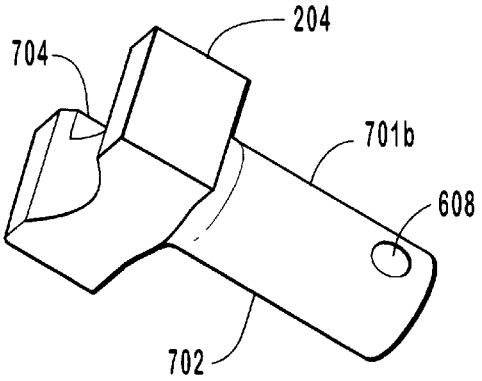
Figure 7C:
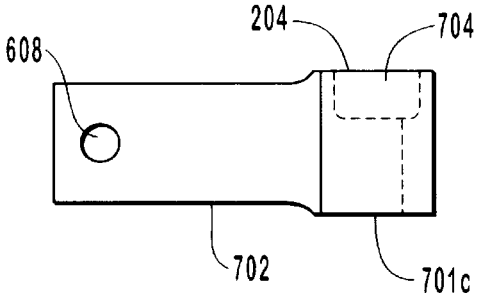
Figure 7D:
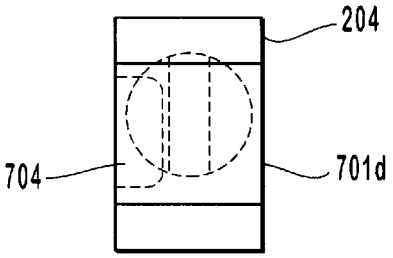
Figure 7E:
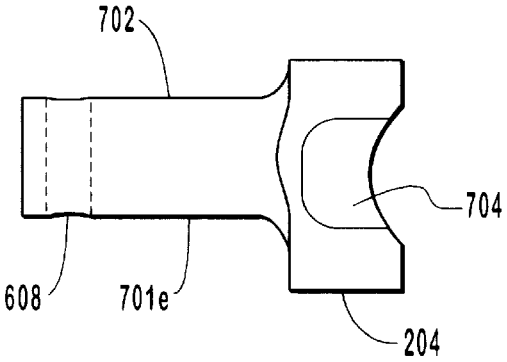

FIG. 6 provides an exploded view of the cocking handle assembly 201. To assemble the component parts of the cocking handle assembly 201, the cocking piece 204 is fitted through the slot 301 and into the cocking piece receptacle 604. A detent spring 602 and detent pin 601 are inserted into a hole (not shown) on the cocking handle 202. The cocking handle 202 with detent pin spring 602 and detent pin 601 are inserted over the cocking piece receptacle 604. The cocking handle 202 and the cocking piece 204 are held in place by inserting the retaining pin 603 through the cocking handle hole 606, through the receptacle hole 607, and through the cocking piece hole 608. This assembly 201 permits the cocking handle 202 to be fixed to the slide 203, while permitting both 202, 203 to slide along the slide channel 205. The detent pin 601 under the force of the detent pin spring 602 engages the detent hole 605.

FIG. 7 provides a variety of views of the cocking piece 204. View 701*a* provides a front perspective view of the cocking piece 204 showing the cocking piece post 702, the cocking piece hole 608 and a recess 704. The recess 704 is provided to catch the operating rod protrusion 105, thereby permitting the cycling of the operating rod 104 by the cocking handle assembly 201. View 701*b* shows the back perspective view of the cocking piece 204. View 701*c* provides a side view of the cocking piece 204. View 701*d* provides an alternative view of the cocking piece 204. View 701*e* provides a rear view of the cocking piece. In the preferred embodiment, the cocking piece 204 is made of steel although alternatively it 204 could be made of a composite material.

Figure 8:
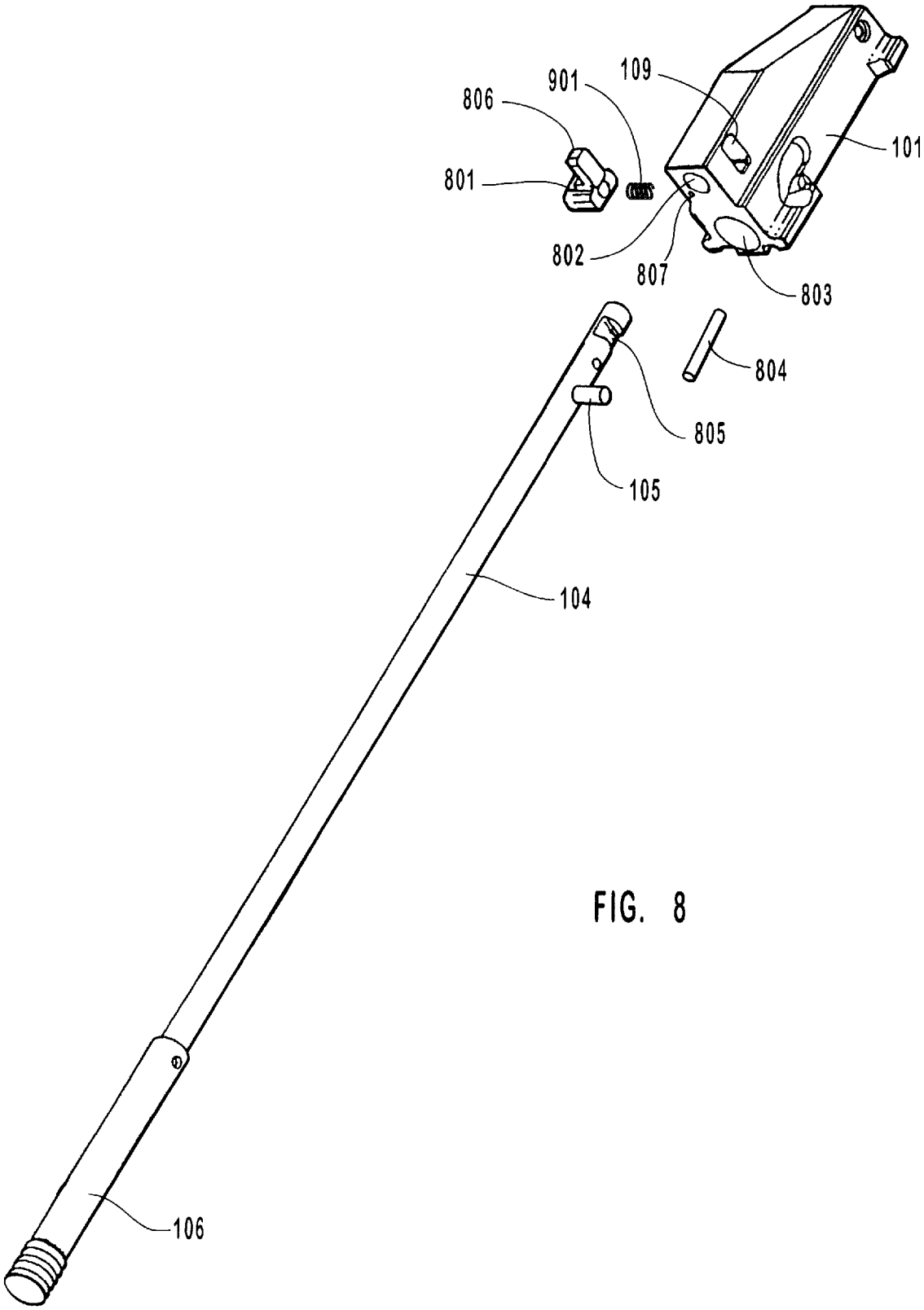
FIG. 8 depicts an exploded view of the preferred bolt carrier with the preferred operating rod.

FIG. 8 shows an exploded view of the preferred bolt carrier 101, without the bolt, but with the operating rod 104 and the operating rod catch 806. The bolt carrier 101 is provided with a bolt opening 803 as well as an operating rod opening 802. The operating rod 104 has the piston 106 affixed at its far end and has the operating rod protrusion 105 and an operating rod catch slot 805. The operating rod catch button 801 is depressed against its spring 901 to release the operating rod 104. This is accomplished by moving the operating rod catch 806 from the operating rod catch slot 805. The operating rod catch 806 is provided with a button section 801, which when pressed by the user releases the operating rod 104 from the bolt carrier 101. The operating rod catch 806 is fixed to the bolt carrier 101 by a bolt carrier release button retaining pin 804 which is inserted in a hole 807 and where the bolt carrier release button retaining pin 804 when inserting in the hole 807 runs across the front side of the operating rod catch 806.

Figure 9:
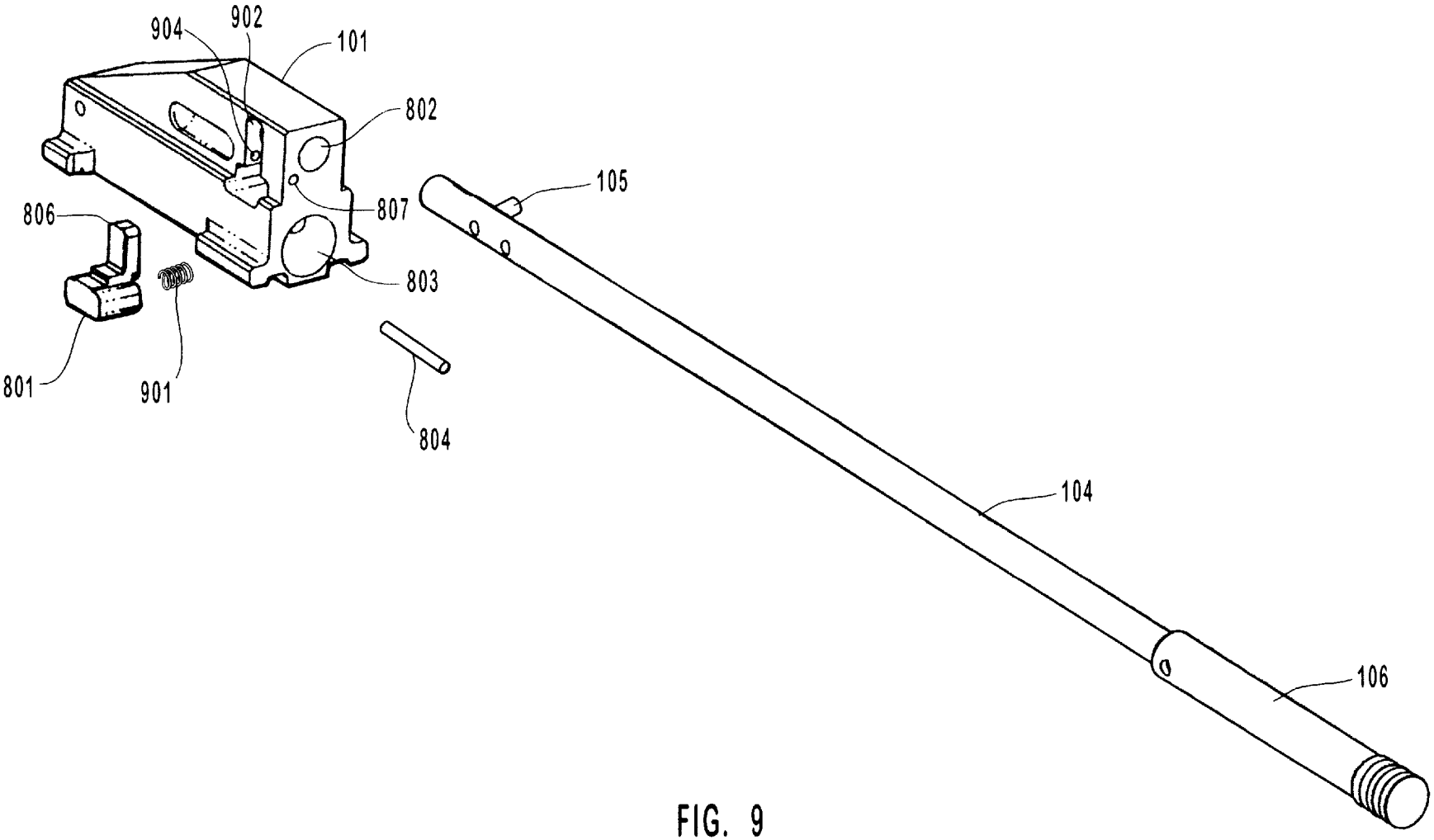
FIG. 9 depicts an alternative exploded view of the preferred bolt carrier with the preferred operating rod.

FIG. 9 provides an alternative, right side, view of the preferred bolt carrier 101, the operating rod 104 and the operating rod catch 806. This view shows the bolt carrier release button spring 901 which is provided to give tension to cause the operating rod catch 806 to be normally engaged into the operating rod catch slot 805. Additional detail of the operating rod catch cavity 902 is provide showing the interior hole 904 into which the bolt carrier release button retaining pin 804 is placed to hold the operating rod catch 806 in place within the operating rod catch cavity 902 of the bolt carrier 101.

Figure 10:
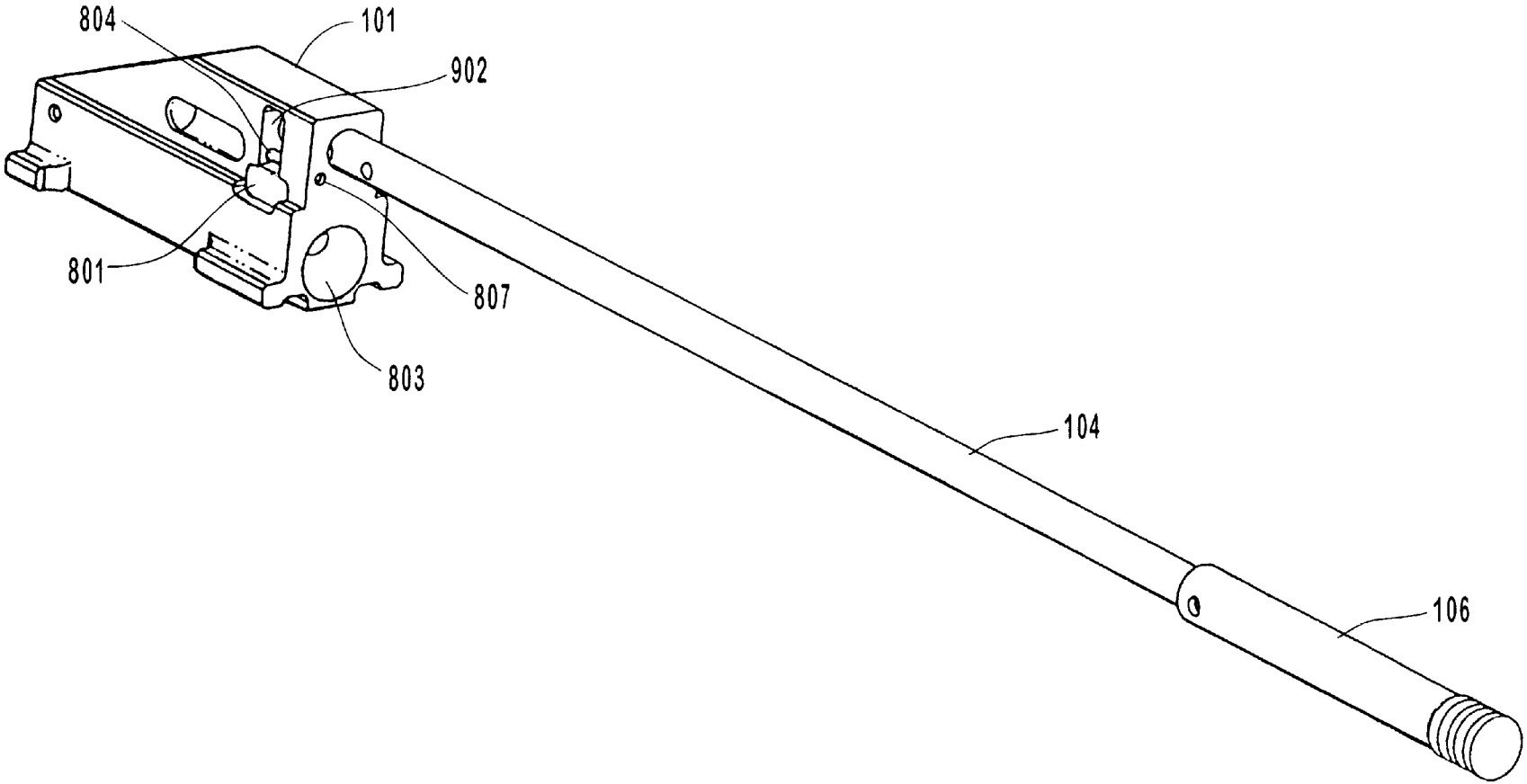
FIG. 10 depicts the right side view of an assembled preferred bolt carrier and preferred operating rod.

FIG. 10 shows the right side view of the assembled bolt carrier 101 attached to the operating rod 104 and the operating rod catch 806. The bolt carrier release button retaining pin 804 is shown having been inserted in the bolt carrier hole 807, past the front of the operating rod catch 806 and into the interior hole 904.

Figure 11:
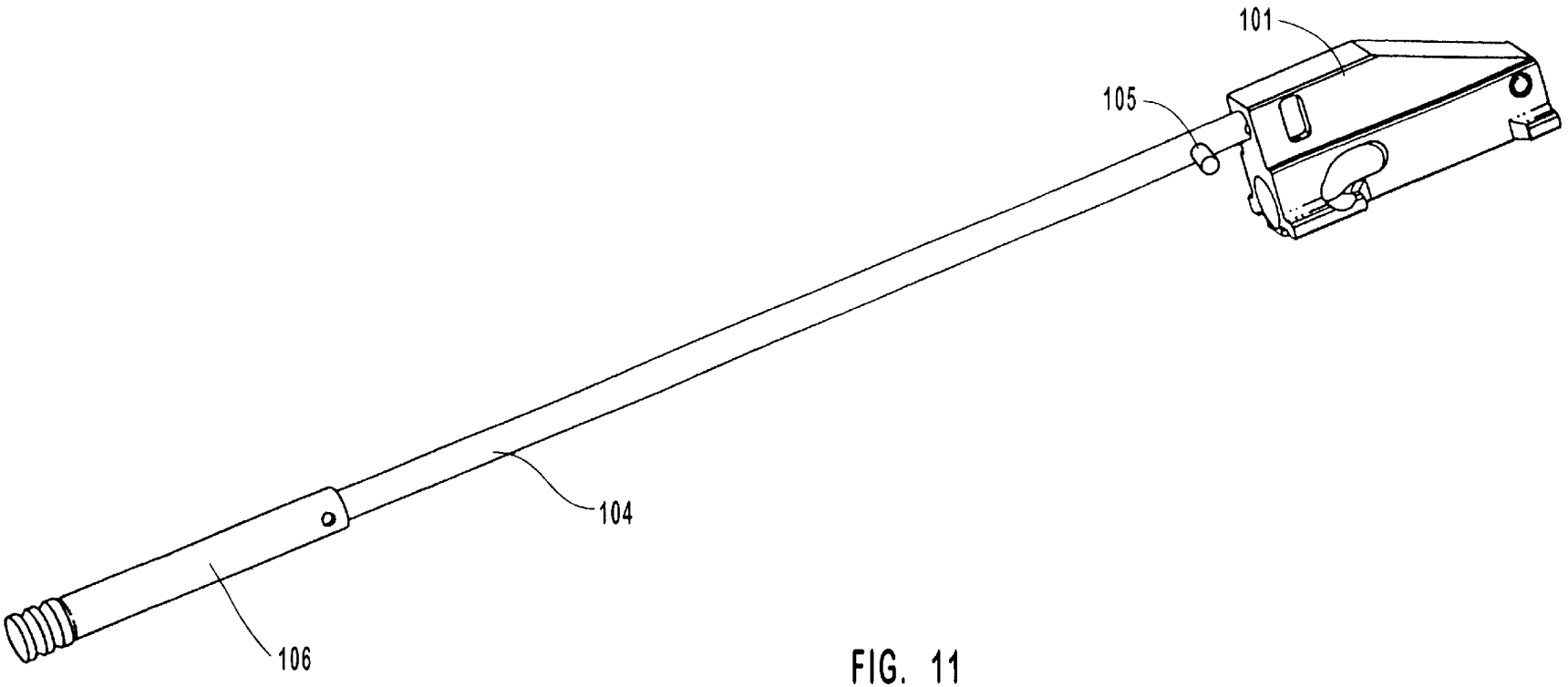
FIG. 11 depicts the left side view of an assembled preferred bolt carrier and preferred operating rod.

FIG. 11 shows the left side view of the bolt carrier 101 assembled to the operating rod 104 and showing the operating rod protrusion 105.

Figure 12:
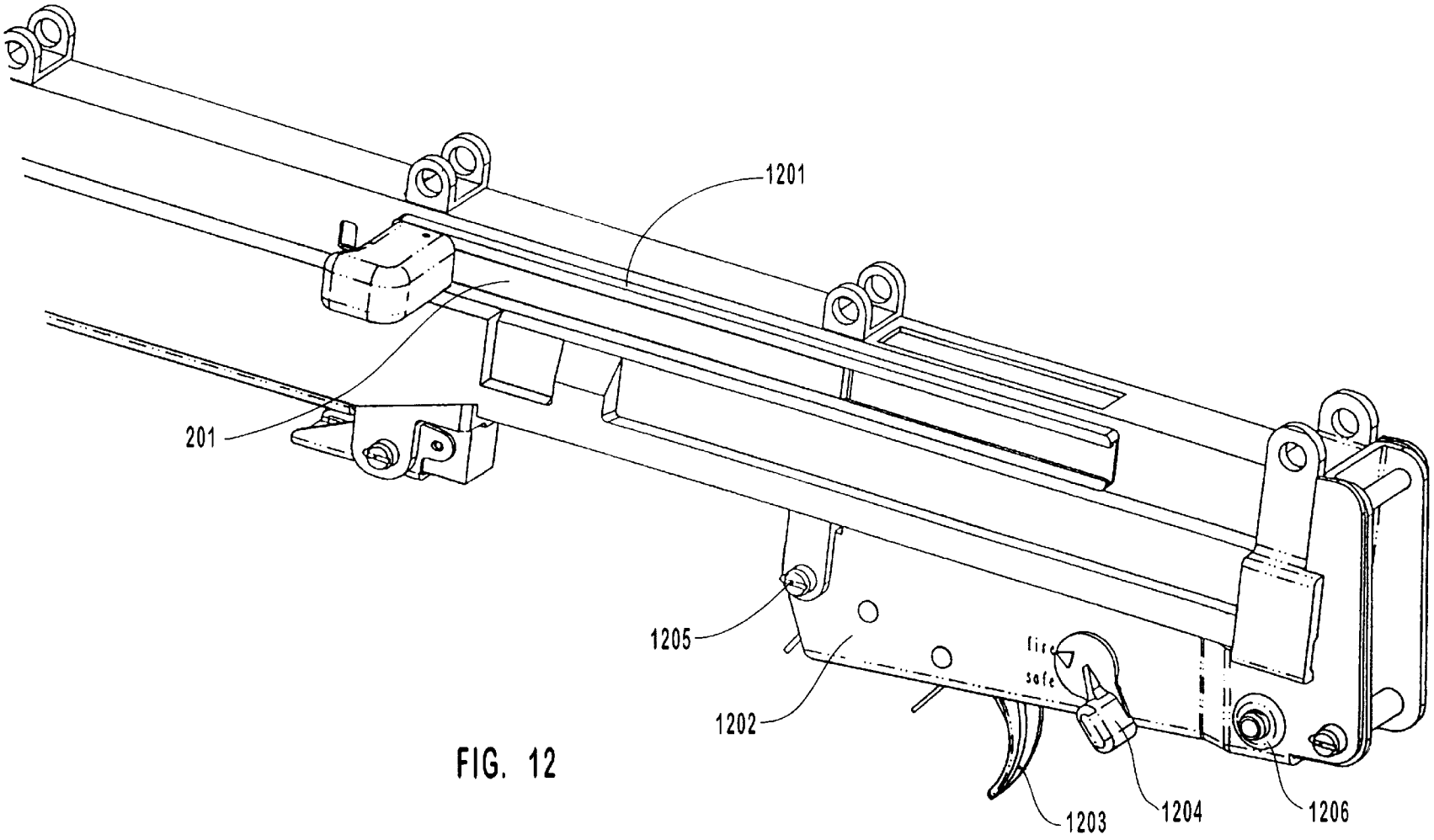
FIG. 12 depicts the preferred upper and lower receiver with the lower receiver attached to the bottom of the upper receiver.

FIG. 12 shows the preferred receiver configured with the lower receiver, containing the fire control components, attached to the bottom of the upper receiver. An upper receiver 1201 is provided fixed to a lower receiver 1202 by pin mounts 1205 and 1206. The lower receiver 1202 is shown with a standard trigger 1203 attached thereto, as well as having a standard firearm safety switch 1204 mounted just behind the trigger. The non-reciprocating cocking handle assembly 201 is shown attached to the upper receiver 1201. In its preferred embodiment the receiver is made of steel sheet metal, although alternative materials, such as other metals, injection molded plastic or other composite materials could also be used without departing from the concept of this invention.

Figure 13:
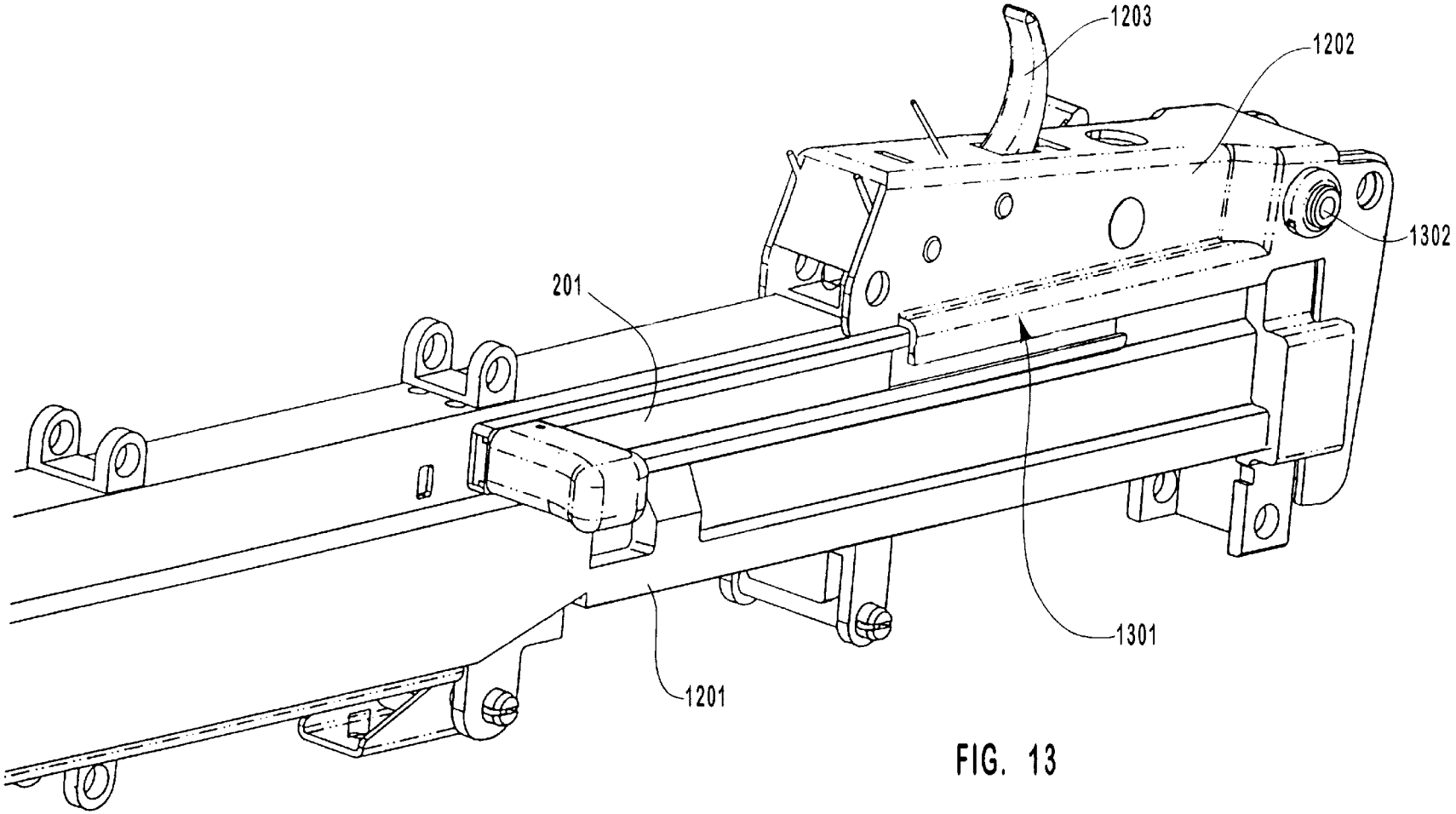
FIG. 13 depicts the preferred upper and lower receiver with the lower receiver attached to the top of the upper receiver.
Figure 14A:
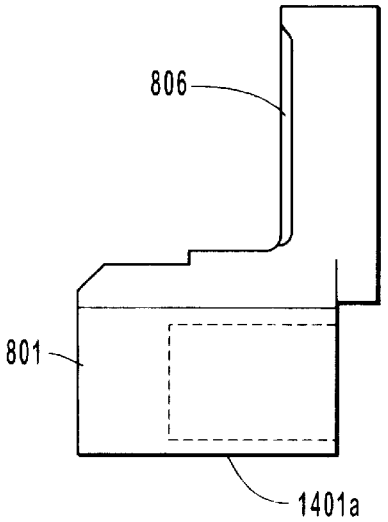
FIG. 14 depicts a variety of detailed views of the preferred bolt carrier release button.
Figure 14C:
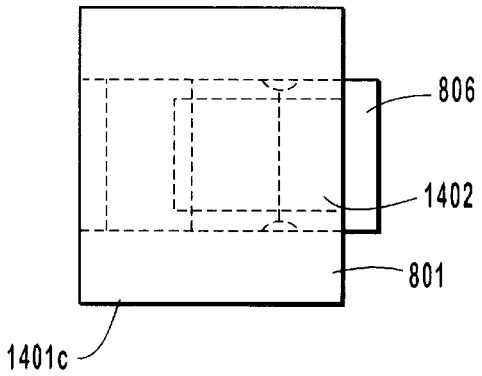
Figure 14B:
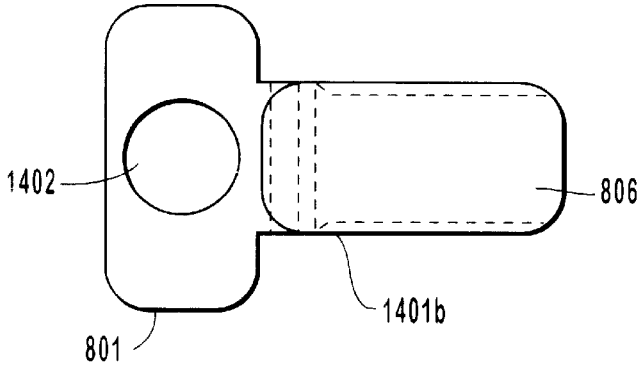
Figure 14D:
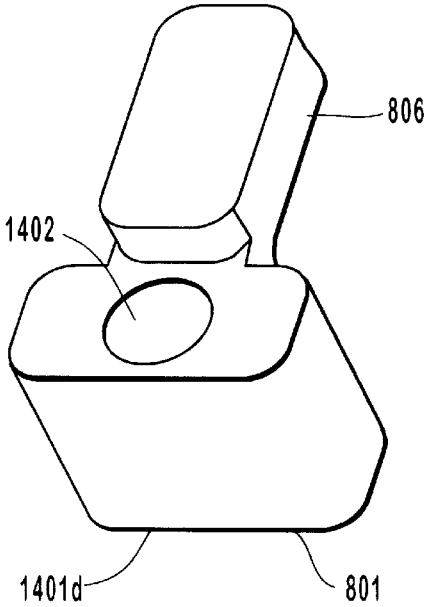

FIG. 13 depicts the preferred receiver with the lower receiver 1202 attached to the top of the upper receiver 1201. An extended edge 1301 is provided on one side of the lower receiver 1202 to provide clearance for the cocking handle assembly 201 when the lower receiver 1202 is attached to the top of the upper receiver 1201.

FIG. 14 provides a variety of detailed views of the preferred operating rod catch 806 and bolt carrier release button 801. View 1401*a* provides side view. View 1401*b* shows a back view of the preferred operating rod catch 806, specifically showing the release button spring opening 1402, which is provided to receive and hold the spring 901. View 1401*c* shows the bottom view of the preferred operating rod catch 806. View 1401*d* provides a perspective view of the operating rod catch 806 showing the proprotionate dimensions as used in the preferred embodiment.

Figure 15:
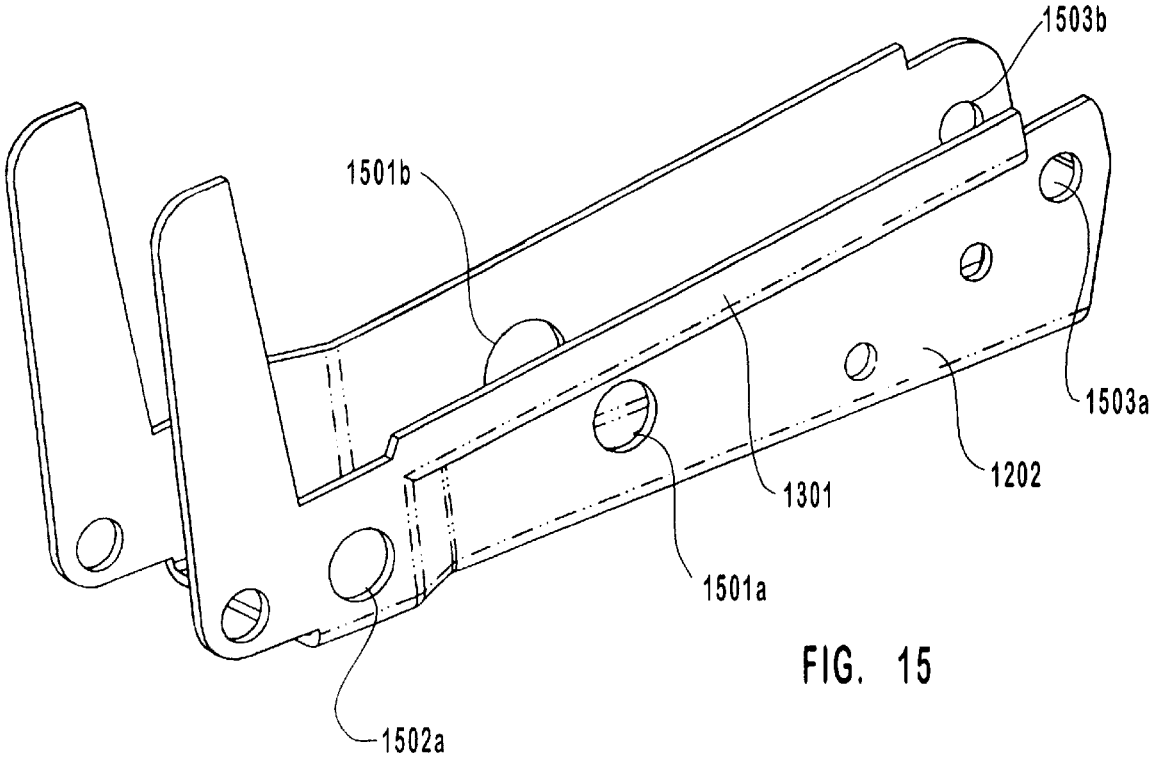
FIG. 15 depicts the preferred lower receiver incorporating the extended edge required for the lower receiver to be attached to the top of the upper receiver.

FIG. 15 shows the preferred lower receiver 1202 of the invention with the extended edge 1301 provided for use when the lower receiver 1202 is attached to the top of the upper receiver 1201. Openings 1502*a* and 1503*a,b* are provided for mounting the lower receiver 1202 to the upper receiver 1201. The openings 1501*a,b* for the safety are also shown.

Figure 16:
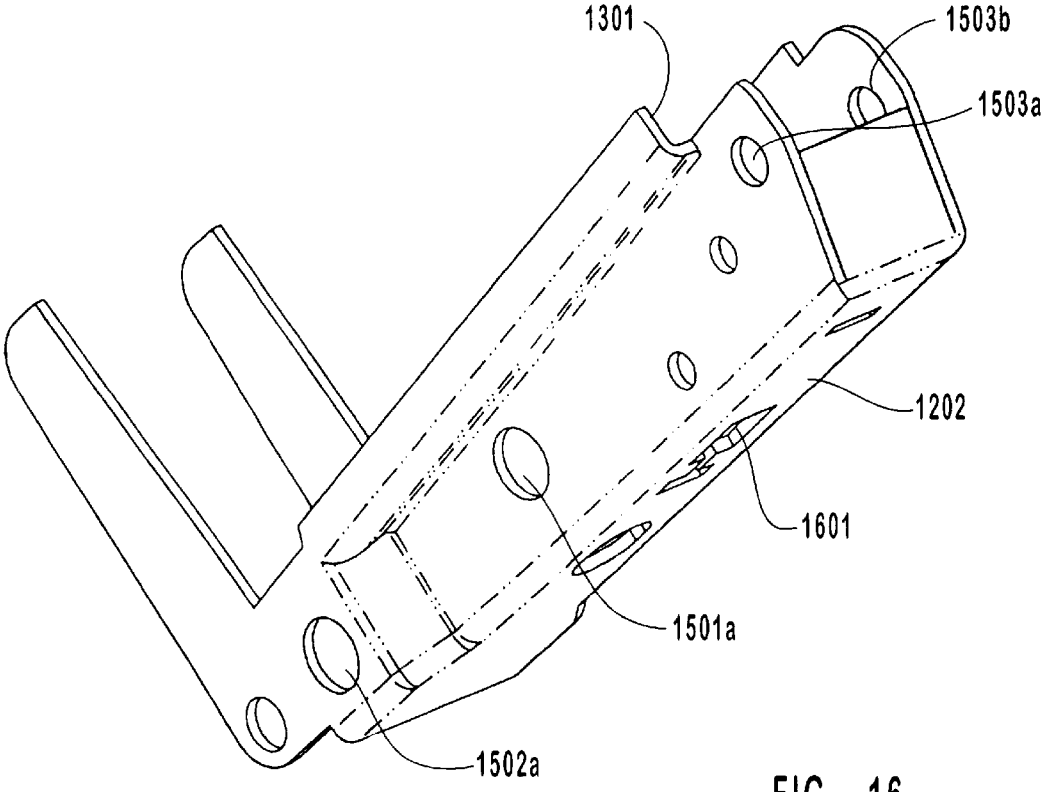
FIG. 16 depicts a reverse view of the preferred lower receiver shell.

FIG. 16 shows a reverse view of the preferred lower receiver 1202 which provides a view of the trigger opening 1601.

Figure 17:
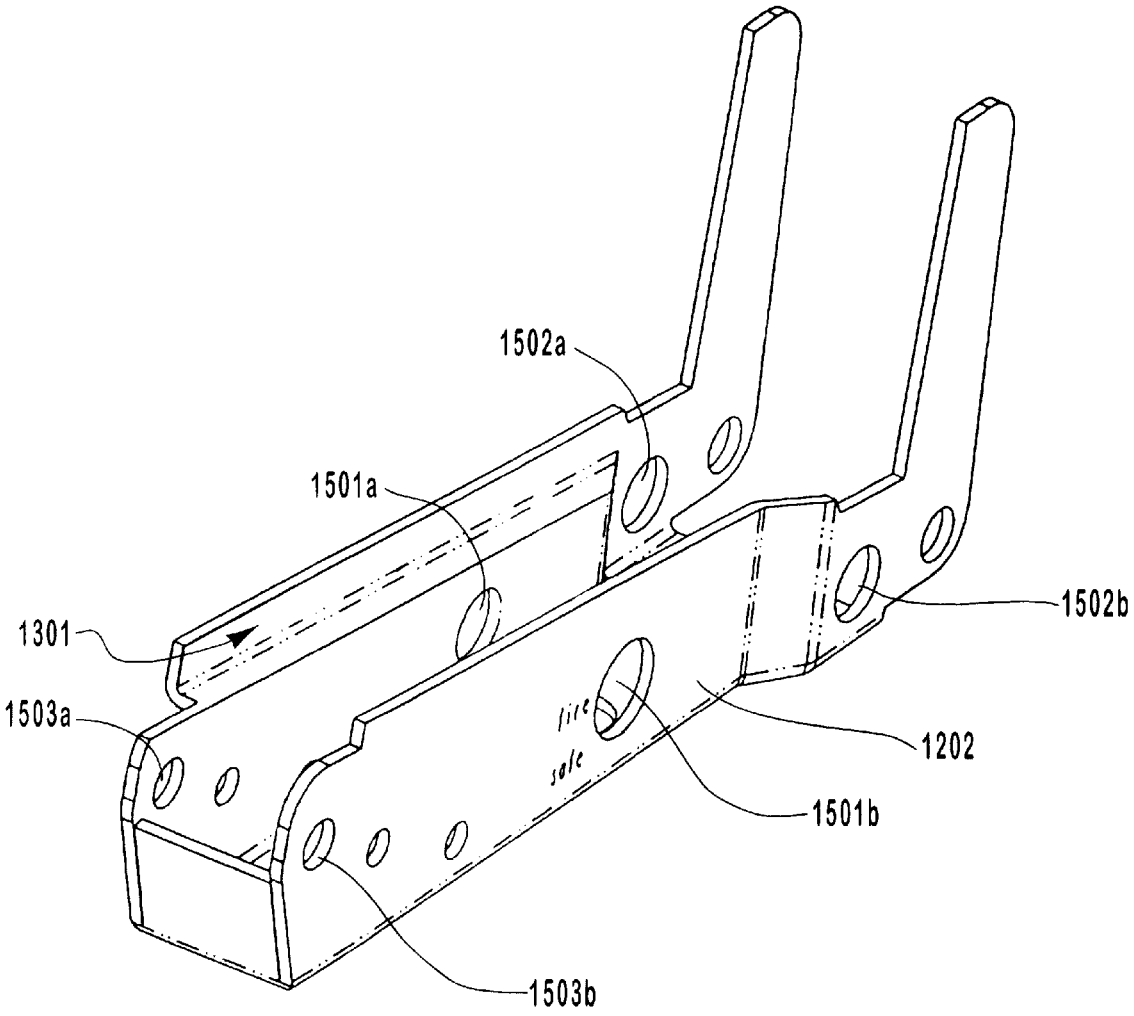
FIG. 17 depicts an alternative view of the preferred lower receiver shell.

FIG. 17 shows an alternative view of the preferred lower receiver 1202, providing additional views of the openings 1502*a,b*, 1501*a,b*, 1503*a,b*.

Figure 18:
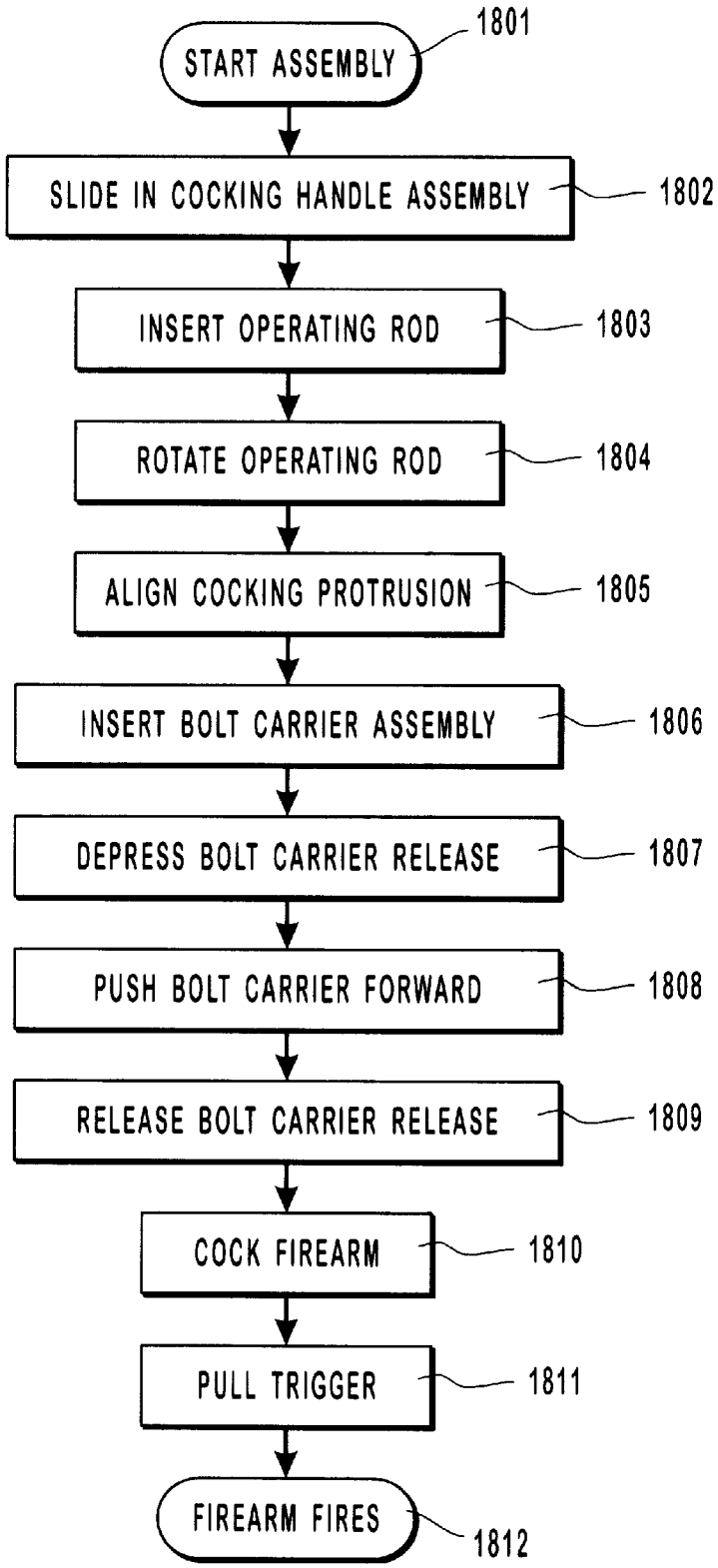
FIG. 18 depicts a process flow diagram for the assembly of the preferred operating system of this invention.

FIG. 18 shows the assembly process flow diagram for the assembly and firing of the operating system of this invention. This invention is designed for easy assembly and disassembly of the operating system by the user, in the field, without requiring special purpose tools. The user begins assembly 1801 by first sliding 1802 the cocking handle assembly 201 completely to the front, to point A 302, of the firearm, that is until the detent pin 601 engages a matching hole 605 in the slide channel 205. Next, the operating rod 104 is inserted 1803 into the upper receiver 1201 with its cocking protrusion 105 aligned with the slot (not shown) in the top of the trunion 103. As the operating rod 104, with its cocking protrusion 105, is pushed through the trunion 103, the recoil spring 108 is stopped from passing through the trunion 103 because it 108 has a larger diameter than the trunion 103 operating rod opening (not shown). The operating rod 104 is next rotated 1804 ninety degrees, once it 104 is pushed into the upper receiver 1201 far enough to clear the cocking piece 204. Now, the cocking protrusion 105 is aligned 1805 with the recess 704 in the cocking piece 204. As pressure on the operating rod 104 is released, the recoil spring 108 pushes the operating rod 104 away from the trunion 103 and forces the cocking protrusion 105 into the recess 704 in the cocking piece 204. Next, the bolt carrier 101 is inserted 1806 into the rear of the upper receiver 1201. As the bolt carrier 101 is pushed forward into the rear end of the upper receiver 1201 the operating rod 104 goes into the operating rod opening 802 of the bolt carrier 101. Next, the bolt carrier release button 801 is depressed 1807 while simultaneously pushing the bolt carrier 101 forward. As the bolt carrier release button 801 is depressed, the operating rod catch 806 is forced against the bolt carrier spring 901 and it 806 is moved out of the path of the operating rod 104. Now, the bolt carrier 104 can be pushed 1808 completely forward until the operating rod 104 contacts the back of its hole 802 in the bolt carrier 101. Now, the button 801 can be released 1809. This forces the operating rod catch 806 into engagement with the notch 805 in the operating rod 104. This firmly attaches the bolt carrier 101 to the operating rod 104.

The user next cocks 1810 the firearm by pulling back on the cocking handle 202, thereby forcing the detent pin 601 from its hole 605. The cocking piece 204 then contacts the operating rod protrusion 105 and encounters the force of the recoil spring 108. As the cocking handle 202 is pulled further to the rear, the bolt carrier 101 moves further to the rear coming into contact with the hammer of the firearm. The hammer is forced downward until it is caught by the sear surface of the trigger 1203. Now, the user can pull 1811 the trigger 1203, releasing the hammer from the trigger sear surface (not shown) so that the hammer can strike the firing pin which in turn fires the cartridge. The operating system now operates similarly to that of other gas operated firearms.

The described embodiments of this invention are intended to be descriptive of the current best mode of the invention and as illustrative of numerous and varied other embodiments which may constitute applications of the principles of this invention. Such other embodiments may be readily devised by those skilled in the art, after review of this disclosure, without departing from the spirit or scope of this invention. It is the inventors' intent that such other embodiments as are indicated by the appended claims and their equivalents be deemed to be within the scope of this invention.

We claim:

1. An operating system for rifles comprising (A) a bolt carrier adapted for receiving an operating rod and having an operating rod catch;

(B) said operating rod having a catch slot, to receive said operating rod catch, and a protrusion to engage a cocking device, and wherein said operating rod catch further comprises:

(i) a catch for fixing said received operating rod;

(ii) a button section for releasing said catch from said received operating rod; and (iii) a spring element for holding said catch normally in contact with said received operating rod; and (C) a receiver containing said cocking device.

2. An operating system for rifles, comprising:

(A) a bolt carrier adapted for receiving an operating rod and having an operating rod catch;

(B) said operating rod having a catch slot to receive said operating rod catch and a protrusion to engage a cocking device; and (C) a receiver containing said cocking device, wherein said cocking device further comprises:

(i) a cocking handle;

(ii) a slide attached to said cocking handle;

(iii) a slide channel within which said slide moves;

(iv) a cocking piece fixed to said cocking handle, wherein said cocking piece has a recess for contacting said operating rod protrusion; and (v) a detent pin connected to said slide to restrain the movement of said slide within said slide channel.

3. An operating system for rifles, comprising:

(A) a bolt carrier adapted for receiving an operating rod and having an operating rod catch;

(B) said operating rod having a catch slot to receive said operating rod catch and a protrusion to engage a cocking device; and (C) a receiver containing said cocking device, wherein said receiver further comprises an upper receiver and a lower receiver, and wherein said upper receiver further comprises a top side, a bottom side, and a mount adapted for receiving said lower receiver on either said top side of said upper receiver or said bottom side of said upper receiver.

4. A process for the user assembly of an operating system for rifles, comprising:

(A) sliding a cocking handle assembly into the front of a rifle;

(B) inserting an operating rod into a receiver;

(C) rotating said operating rod to clear a cocking piece;

(D) aligning a cocking protrusion with a recess on said cocking piece;

(E) inserting a bolt carrier into said receiver;

(F) depressing a bolt carrier release button to permit said operating rod to contact an operating rod catch;

(G) pushing said bolt carrier forward until said operating rod contacts said bolt carrier; and (H) releasing said bolt carrier release button to lock said operating rod to said bolt carrier.

* * * * *